US006863776B2

(12) United States Patent
Begemann et al.

(10) Patent No.: US 6,863,776 B2
(45) Date of Patent: Mar. 8, 2005

(54) PRESS SECTION

(75) Inventors: Ulrich Begemann, Heidenheim (DE); Ingolf Cedra, Heidenheim (DE); Thomas Augscheller, Bachhagel (DE); Georg Kleiser, Schwäbisch Gmünd (DE)

(73) Assignee: Voith Paper Patent GmbH, Heidenheim (DE)

( * ) Notice: Subject to any disclaimer, the term of this patent is extended or adjusted under 35 U.S.C. 154(b) by 167 days.

(21) Appl. No.: 10/247,339

(22) Filed: Sep. 20, 2002

(65) Prior Publication Data

US 2003/0101881 A1 Jun. 5, 2003

(30) Foreign Application Priority Data

Dec. 1, 2001 (DE) ..... 101 59 115

(51) Int. Cl.[7] ..... D21F 3/04

(52) U.S. Cl. ..... 162/205; 162/205; 162/306; 162/358.1; 162/358.2; 162/358.3; 162/358.4; 162/358.5; 162/359.1; 162/360.2; 162/361

(58) Field of Search ..... 162/205, 206, 162/306, 358.1, 358.2, 358.4, 358.5, 359.1, 360.2, 360.3, 361

(56) References Cited

U.S. PATENT DOCUMENTS 5,468,349 A * 11/1995 Schiel ..... 162/358.3
5,650,049 A 7/1997 Kivimaa et al.
5,662,778 A 9/1997 Laapotti
5,681,431 A * 10/1997 Steiner ..... 162/360.2
5,762,761 A 6/1998 Kivimaa et al.
5,766,422 A * 6/1998 Crouse ..... 162/358.5
5,876,565 A 3/1999 Laapotti

FOREIGN PATENT DOCUMENTS

DE 19633422 2/1998
EP 0705937 4/1996

OTHER PUBLICATIONS

Patent Abstracts of Japan vol. 2000, No. 18, Jun. 5, 2001, published Jun. 1, 1989 of Japanese Publication No. 01139890.

* cited by examiner

*Primary Examiner*—Peter Chin
(74) *Attorney, Agent, or Firm*—Greenblum & Bernstein, P.L.C.

(57) ABSTRACT

Press section and process for dewatering a fibrous material web that includes a plurality of rolls arranged to form at least three nips and at least one endlessly circulating dewatering belt associated with each nip. Each at least one endlessly circulating dewatering belt is structured and arranged to guide the fibrous material web through its respective nip and to receive water squeezed out of the fibrous material web in the respective nip. The plurality of rolls include at least one press roll having a smooth surface arranged to contact a surface of the fibrous material web and an endlessly circulating, smooth transfer belt is structured and arranged to contact a surface of the fibrous material web opposite the surface contacting the smooth surface of the at least one press roll and to support the fibrous material web through at least one of the at least three nips.

40 Claims, 1 Drawing Sheet

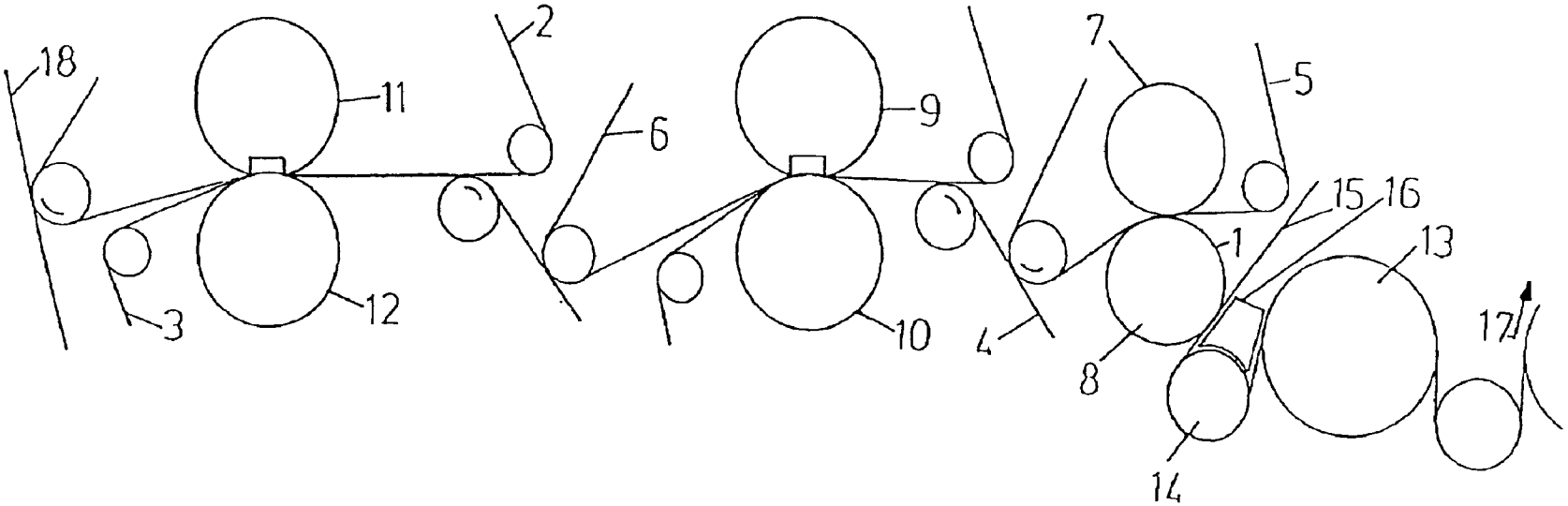
1
2
3
4
5
6
7
8
9
10
11
12
13
14
15
16
17
18

PRESS SECTION

CROSS-REFERENCE TO RELATED APPLICATIONS

The present application claims priority under 35 U.S.C. §119 of German Patent Application No. 101 59 115.2, filed on Dec. 1, 2001, the disclosure of which is expressly incorporated by reference herein in its entirety.

BACKGROUND OF THE INVENTION

1. Field of the Invention

The invention relates to a press section for dewatering a paper, cardboard, tissue or other fibrous material web with at least three nips, whereby, in addition to the fibrous material web, at least one endlessly circulating dewatering belt for receiving the squeezed out water is guided through the nip, and at least one press roll involved in the formation of a nip features a smooth surface and comes into contact with the fibrous material web.

2. Discussion of Background Information

Presses with three nips are known, whereby the first two are usually embodied in an extended manner in the interest of a high dewatering capacity and are double-felted, and the last nip is single-felted. A high degree of smoothness also results in addition to a good and gentle dewatering. The smoothness essentially results from the contact of the fibrous material web with a smooth press roll in the last nip. However, a marked two-sidedness with regard to the smoothness hereby results, which in the following glazing device of the paper machine can be compensated for only inadequately or at the expense of the controllability of other properties of the fibrous material web, such as, e.g., the calender blackening.

SUMMARY OF THE INVENTION

The present invention ensures—in addition to a high dewatering capacity—a low two-sidedness regarding coarseness in the press section.

According to the invention, the fibrous material web is guided through at least one nip together with an endlessly circulating, smooth transfer belt, whereby the transfer belt comes into contact with the side of the fibrous material web opposite the smooth press roll. It is thereby advantageous if the transfer belt runs through only one nip, and the fibrous material web arrives from the nip with the transfer belt at a following nip, whereby this following nip is formed by two press rolls, one of which features a smooth surface and comes into contact with the fibrous material web.

The three nips ensure a high dewatering capacity. Moreover, the smoothness on both sides of the fibrous material web is increased by approximately the same extent by the contact of the fibrous material web with a smooth transfer belt in a nip and the contact of the opposite side of the fibrous material web with the smooth press roll in the preferably following nip.

In the interest of a gentle and yet intensive dewatering, the nip with the transfer belt should be embodied in an extended manner and preferably formed by a shoe roll and a cylindrical opposing roll. In order to shift the glazing to the end of the press section, a nip should be upstream of the nip with the transfer belt, and this upstream nip should preferably form the first nip of the press section.

The essential part of the dewatering thus takes place in the two first nips, whereby one each dewatering belt should be guided on each side of the fibrous material web because of the large water yield due to the upstream nip.

Depending on the type and moisture content of the fibrous material web and on the requirements made, the upstream nip can be embodied in an extended manner and preferably formed by a shoe roll and a cylindrical opposing roll or by two cylindrical press rolls to minimize the expense.

In order to prevent an impairment of the smoothness of the fibrous material web achieved in the press section, the following nip should be the last nip of the press section. It is thereby sufficient for the following nip to be formed by two cylindrical press rolls. For the glazing result and in the interest of a preheating of the fibrous material web for a subsequent drying process, it is advantageous if at least one press roll of the following nip is heated, whereby this heated press roll preferably comes into contact with the fibrous material web.

The reliable guidance of the fibrous material web and the avoidance of edge tears or breaks causes considerable problems, particularly at high web speeds and/or with low basis weights of the fibrous material web. The fibrous material web should therefore be supported at least from the first to the last nip of the press section by at least one belt in the form of a dewatering belt, transfer belt, or the like.

To dry the fibrous material web, the press section is generally followed by a dryer section with preferably several dryer groups for drying the fibrous material web. In the interest of a low risk of breaks, at least the first dryer group of the dryer section should be formed by a row of drying cylinders between which guide rolls are arranged, whereby the fibrous material web, supported by a drying screen, winds around the drying cylinders and guide rolls in a meandering manner. For reasons of simplification or for reconstructions, this permits the heated press roll of the following nip to be formed by a drying cylinder.

In the areas between guide roll and drying cylinder a suction device is thereby assigned to the drying screen, which suction device intensifies the adhesion of the fibrous material web to the drying screen. In order to be able to ensure the reliable and defined detachment of the fibrous material web from the respective drying cylinder, a suction zone with increased underpressure should be present in this area. This permits very high web speeds in connection with the relatively high dry matter contents in the press section and a guiding of the fibrous material web that is as closed as possible.

A particularly simple structure results when the transfer belt runs over the fibrous material web. The dewatering belt that runs under the transfer belt can thereby transfer the fibrous material web directly to the dewatering belt of the following nip running above the fibrous material web. This in turn permits the smooth press roll arranged under the fibrous material web to preferably transfer the fibrous material web directly to the drying screen of the first dryer group running above the fibrous material web. Drying groups with a drying screen running above the fibrous material web offer considerable advantages in the event of possible breaks or during transport, since the fibrous material web can be conducted into the machine cellar without difficulty. The transfer of the fibrous material web to the drying screen can be advantageously supported by a suction device in the form of a suction roll, a suction box, or the like, around which the drying screen is wound.

However, if the transfer belt runs under the fibrous material web, it is advantageous if the fibrous material web is transferred from the transfer belt to another, preferably air-permeable transfer belt, and from this to the dewatering belt of the following nip running under the fibrous material web. The dewatering belts, as well as preferably the air-permeable transfer belt, should be embodied as press felt. The smooth transfer belt should be air- and water- impermeable.

It is also possible for the smooth transfer belt to run only through the last nip, and for the smooth press roll to be present in the second nip and come into contact with the fibrous material web.

The realization of a glazing nip by means of the smooth press roll and the opposite transfer belt of the other press roll of this press nip can also be advantageous.

The present invention is directed to a press section for dewatering a fibrous material web that includes a plurality of rolls arranged to form at least three nips and at least one endlessly circulating dewatering belt associated with each nip. Each at least one endlessly circulating dewatering belt is structured and arranged to guide the fibrous material web through its respective nip and to receive water squeezed out of the fibrous material web in the respective nip. The plurality of rolls include at least one press roll having a smooth surface arranged to contact a surface of the fibrous material web and an endlessly circulating, smooth transfer belt is structured and arranged to contact a surface of the fibrous material web opposite the surface contacting the smooth surface of the at least one press roll and to support the fibrous material web through at least one of the at least three nips.

In accordance with a feature of the invention, the fibrous material web can include one of a paper, cardboard, or tissue web.

According to another feature of the invention, the transfer belt can be arranged to run through only one of the at least three nips.

The at least one press roll having a smooth surface can be arranged to form its respective nip after the at least one nip in which the smooth transfer belt supports the fibrous material web. The smooth transfer belt is not arranged to be guided through the respective nip formed by the at least one press roll having a smooth surface. Further, the respective nip formed by the at least one press roll having a smooth surface may be a last nip of the press section. The at least one press roll having a smooth surface can be cylindrical press roll and another cylindrical press roll are arranged to form the respective nip, and at least one of the cylindrical press roll and the another cylindrical press roll can be heated. The at least one heated cylinder press roll may be arranged to contact the fibrous material web.

Moreover, at least one nip through which the smooth transfer belt supports the fibrous material web can be an extended nip in a web run direction. The extended nip may be formed between a shoe roll and a cylindrical opposing roll.

One of the at least three nips can be arranged upstream of the at least one nip through which the smooth transfer belt support the fibrous material web relative to a web run direction. The one nip can be arranged to form a first nip of the press section. The at least one dewatering belt for the one nip may include two dewatering belts arranged to sandwich the fibrous material web in the one nip. Further, the one nip upstream of the at least one nip through which the smooth transfer belt supports the fibrous material web can be extended nip in a web run direction, and the extended nip may be formed between a shoe roll and a cylindrical opposing roll.

Moreover, the press section can be arranged so that the fibrous material web is supported at least from a first nip to a last nip. The fibrous material web can be supported by at least one belt, which can include at least one of the dewatering belts and the smooth transfer belt.

According to a further feature of the present invention, a dryer section may include several dryer groups arranged to dry the fibrous material web is positioned to follow the press section in a web run direction. At least a first dryer group of the dryer section can include a row of drying cylinders, a plurality of guide rolls and a drying screen arranged to wind around the drying cylinders and guide rolls along a meandering path, such that the drying screen is structured and arranged to guide the fibrous material web through the first dryer group along the meandering path. A last nip of the press section can be formed by the at least one press roll having a smooth surface and a counter roll, and at least one of the at least one press roll and the counter roll comprises a drying cylinder.

In accordance with still another feature of the instant invention, the smooth transfer belt can be arranged to contact an upper surface of the fibrous material web. The at least one dewatering belt of the at least one nip through which the smooth transfer belt is guided is positioned under the fibrous material web and is arranged to transfer the fibrous material web directly to the at least one dewatering belt of a following nip, wherein the at least one dewatering belt of the following nip is arranged above the fibrous material web. The following nip can include the at least one press roll having a smooth surface, which is positioned under the fibrous material web and is arranged to transfer the fibrous material web to a drying screen of a first dryer group, such that the drying screen is positioned above the fibrous material web. Further, a suction device, over which the drying screen is guided, can be arranged to support the transfer of the fibrous material web to the drying screen. The suction device can include a suction roll or a suction box.

According to another feature, the smooth transfer belt may be arranged to contact a lower surface of the fibrous material web. An air-permeable transfer belt can be arranged downstream of the smooth transfer belt, such that the fibrous material web is transferred from the smooth transfer belt to the air-permeable transfer belt, and, subsequently, the fibrous material web is transferred from the air-permeable transfer belt to the at least one dewatering belt of a following nip located below the fibrous material web. The dewatering belts and the air permeable transfer belt can include press felts.

According to still another feature of the invention, the dewatering belt can include press felts.

In accordance with yet another feature of the present invention, the smooth transfer belt can be air- and water-impermeable.

The present invention is directed to a process for dewatering a fibrous material web in a press section. The press section includes at least three nips, at least one endlessly circulating dewatering belt associated with each nip, at least one press roll having a smooth surface arranged to form part of one of the at least three nips, and an endlessly circulating, smooth transfer belt. The process includes guiding the fibrous material belt through each of the at least three nips with the at least one dewatering belt associated with each nip, receiving in each at least one dewatering belt the water pressed out of the fibrous material web in a respective nip, contacting a surface of the fibrous material web with the smooth transfer belt, wherein the smooth transfer belt supports the fibrous material web through at least one of said at least three nips, and contacting a surface of the fibrous material web opposite the surface contacted by the smooth transfer belt with the smooth surface of the at least one press roll that supports the fibrous material web through the one nip formed in part by the at least one press roll.

In accordance with a feature of the instant invention, the transfer belt can be arranged to run through only one of said at least three nips.

In accordance with still yet another feature of the present invention, the transfer belt does not run through the one nip formed in part by the at least one press roll. Further, the one nip formed in part by the at least one press roll is located downstream, relative to a web run direction, from the at least one nip through which the smooth transfer belt is guided, and is a last nip in the press section. Upstream of the at least one nip through which the smooth transfer belt is guided, a first of the at least three nips is located, and the fibrous material web is sandwiched between two dewatering belts in the first nip.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

The FIGURE shows a diagrammatic cross section through a press section according to the invention and the start of a following press section of a paper machine for manufacturing the fibrous material web 1.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The press section has three nips that are formed by two each rotating press rolls 7, 8, 9, 10, 11, 12 pressed against one another, whereby at least one dewatering belt 2, 3, 4, 5 is guided through each nip in addition to the fibrous material web 1. The endlessly circulating dewatering belts 2, 3, 4, 5 are used to receive and carry away the water squeezed out of the fibrous material web 1 in the nip and are embodied here as air- and water-permeable press felts.

The first two nips of the press section are embodied in an extended manner and are formed respectively by a shoe roll 9, 11 above the fibrous material web 1 and a lower cylindrical opposing roll 10, 12. The extended nip renders possible an intensive and yet gentle dewatering of the fibrous material web 1. The shoe rolls 9, 11 have a flexible roll jacket for forming an extended nip, which roll jacket is guided over a pressure element with a concave pressure surface in the area of the nip.

Due to the large water yield, particularly in the first nip, one dewatering belt 2,3 each is guided through this first nip on both sides of the fibrous material web 1. The dewatering belt 2 running above the fibrous material web 1 receives the fibrous material web 1 from a forming wire 18 of a former located upstream of the press section for the formation of a sheet.

The lower dewatering belt 3 of the first nip transfers the fibrous material web 1 after the nip to a smooth, endlessly circulating, air- and water-impermeable transfer belt 6 of the second nip, which runs over the fibrous material web 1. The fibrous material web 1 subsequently runs through the second nip together with the transfer belt 6 and the dewatering belt 4 running underneath. Because of the pre-dewatering in the first upstream nip, in the second nip one dewatering belt 4 is sufficient to receive the squeezed out water. In addition to a further dewatering, a glazing of the upper side of the fibrous material web 1 occurs in the second nip through the contact with the smooth transfer belt 6.

After the second nip, the lower dewatering belt 4 of the second nip transfers the fibrous material web 1 to a dewatering belt 5 of the following, last nip of the press section, which dewatering belt runs over the fibrous material belt 1. This third nip is formed by two cylindrical press rolls 7, 8, one of which is embodied as bending-controlled. The fibrous material web 1 thereby comes into direct contact with the lower press roll 8, before, in and after the last nip. To increase the smoothness of the underside of the fibrous material web 1, the lower press roll 8 therefore has a smooth and closed surface. It is thus possible to considerably reduce the two-sidedness of the smoothness. Moreover, the lower press roll 8 is also heated, so that a predrying of the fibrous material web 1 already occurs. Furthermore, due to the formation of a steam cushion, this heating promotes the detachment and transfer of the fibrous material web 1 to a drying screen 15 of the first dryer group of the following dryer section for drying the fibrous material web 1. To this end the drying screen 15 is guided directly onto the lower press roll 8, whereby the pickup of the fibrous material web 1 is supported by a suction device 16 in the form of a known suction box around which a drying screen 15 is wound.

At least the first dryer group is formed by a row of drying cylinders 13, between which guide rolls 14 are arranged, whereby the fibrous material web 1, supported by the drying screen 15, winds around the dryer cylinders 13 and guide rolls 14 in a meandering way. The fibrous material web 1 thereby comes into direct contact with the heated dryer cylinders 13 for drying. Similar or also other dryer groups of the dryer section can then follow in the web travel direction 17.

In general, the acceptance of the fibrous material web 1 can be supported by an air-permeable dewatering belt 2, 5 with the aid of a suctioned roll wound around by the respective dewatering belt 2, 5. It is also possible to let the transfer belt 6 run under the fibrous material web 1. Of course, in that case the smooth press roll 8 of the following last nip has to be arranged over the fibrous material web 1. The interposition of an air-permeable transfer belt can be necessary here.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A press section for dewatering a fibrous material web comprising:

a plurality of rolls arranged to form at least three nips;

at least one endlessly circulating dewatering belt associated with each nip, each said at least one endlessly circulating dewatering belt being structured and arranged to guide the fibrous material web through its respective nip and to receive water squeezed out of the fibrous material web in said respective nip;

said plurality of rolls comprising at least one press roll having a smooth surface arranged to contact a surface of the fibrous material web; and an endlessly circulating, smooth transfer belt structured and arranged to contact a surface of the fibrous material web opposite the surface contacting said smooth surface of said at least one press roll and to support the fibrous material web through at least one of said at least three nips, wherein said at least one press roll having a smooth surface is arranged to form its respective nip after said at least one nip in which said smooth transfer belt supports the fibrous material web, and wherein the at least one dewatering belt associated with said at least one nip in which said smooth transfer belt supports the fibrous material web is arranged to transfer the fibrous material web directly to the at least one dewatering belt guided through said respective nip formed by said at least one press roll having a smooth surface.

2. The press section in accordance with claim 1, wherein the fibrous material web comprises one of a paper, cardboard, or tissue web.

3. The press section in accordance with claim 1, wherein said smooth transfer belt is arranged to run through only one of said at least three nips.

4. The press section in accordance with claim 1, wherein said smooth transfer belt is not arranged to be guided through said respective nip formed by said at least one press roll having a smooth surface.

5. The press section in accordance with claim 1, wherein said respective nip formed by said at least one press roll having a smooth surface is a last nip of said press section.

6. The press section in accordance with claim 1, wherein said at least one press roll having a smooth surface is cylindrical press roll and wherein said cylindrical press roll and another cylindrical press roll are arranged to form said respective nip.

7. The press section in accordance with claim 7, wherein at least one of said cylindrical press roll and said another cylindrical press roll are heated.

8. The press section in accordance with claim, 7, wherein said at least one heated cylindrical press roll is arranged to contact the fibrous material web.

9. The press section in accordance with claim 1, wherein said at least one nip through which said smooth transfer belt supports the fibrous material web is an extended nip in a web run direction.

10. The press section in accordance with claim 9, wherein said extended nip is formed between a shoe roll and a cylindrical opposing roll.

11. The press section in accordance with claim 1, wherein one of said at least three nips is arranged upstream of said at least one nip through which said smooth transfer belt supports the fibrous material web relative to a web run direction.

12. The press section in accordance with claim 11, wherein said one nip is arranged to form a first nip of said press section.

13. The press section in accordance with claim 11, wherein said at least one dewatering belt for said one nip comprises two dewatering belts arranged to sandwich the fibrous material web in said one nip.

14. The press section in accordance with claim 11, wherein said one nip upstream of said at least one nip through which said smooth transfer belt supports the fibrous material web is an extended nip in a web run direction.

15. The press section in accordance with claim 14, wherein said extended nip is formed between a shoe roll and a cylindrical opposing roll.

16. The press section in accordance with claim 1, wherein said press section is arranged so that the fibrous material web is supported at least from a first nip to a last nip.

17. The press section in accordance with claim 16, wherein the fibrous material web is supported by each of said dewatering belts and said smooth transfer belt.

18. The press section in accordance with claim 1, wherein a dryer section comprising several dryer groups arranged to dry the fibrous material web is positioned to follow the press section in a web run direction.

19. The press section in accordance with claim 18, wherein at least a first dryer group of said dryer section comprises a row of drying cylinders, a plurality of guide rolls and a drying screen arranged to wind around the drying cylinders and guide rolls along a meandering path, wherein said drying screen is structured and arranged to guide the fibrous material web through said first dryer group along said meandering path.

20. The press section in accordance with claim 18, wherein a last nip of said press section is formed by said at least one press roll having a smooth surface and a counter roll.

21. The press section in accordance with claim 1, wherein said smooth transfer belt is arranged to contact an upper surface of the fibrous material web.

22. The press section in accordance with claim 21, wherein said at least one dewatering belt of said at least one nip through which said smooth transfer belt is guided is positioned under the fibrous material web and wherein the at least one dewatering belt of said respective nip formed by said at least one press roll having a smooth surface is arranged above the fibrous material web.

23. The press section in accordance with claim 22, wherein said at least one press roll having a smooth surface is positioned under the fibrous material web and is arranged to transfer the fibrous material web to a drying screen of a first dryer group, wherein said drying screen is positioned above the fibrous material web.

24. The press section in accordance with claim 23, further comprising a suction device, over which said drying screen is guided, arranged to support the transfer of the fibrous material web to the drying screen.

25. The press section in accordance with claim 24, wherein said suction device comprises a suction roll or a suction box.

26. The press section in accordance with claim 1, wherein said smooth transfer belt is arranged to contact a lower surface of the fibrous material web.

27. The press section in accordance with claim 1, wherein the at least one dewatering belt associated with said at least one nip in which said smooth transfer belt supports the fibrous material web is an air-permeable transfer belt.

28. The press section in accordance with claim 27, wherein said dewatering belts and said air permeable transfer belt comprise press felts.

29. The press section in accordance with claim 1, wherein said dewatering belts comprise press felts.

30. The press section in accordance with claim 1, wherein said smooth transfer belt is air- and water-impermeable.

31. A process for dewatering a fibrous material web in a press section, the press section including at least three nips, at least one endlessly circulating dewatering belt associated with each nip, at least one press roll having a smooth surface arranged to form part of one of the at least three nips, and an endlessly circulating, smooth transfer belt, said process comprising:

guiding the fibrous material belt through each of the at least three nips with the at least one dewatering belt associated with each nip;

receiving in each at least one dewatering belt the water pressed out of the fibrous material web in a respective nip;

contacting a surface of the fibrous material web with the smooth transfer belt, wherein the smooth transfer belt supports the fibrous material web through at least one of said at least three nips;

transferring the fibrous material web with the at least one dewatering belt associated with the at least one nip in which said smooth transfer belt supports the fibrous material web directly to the at least one dewatering belt guided through the one nip formed by the at least one press roll; and contacting a surface of the fibrous material web opposite the surface contacted by the smooth transfer belt with the smooth surface of the at least one press roll that supports the fibrous material web through the one nip formed in part by the at least one press roll.

32. The process in accordance with claim 31, wherein the smooth transfer belt is arranged to run through only one of said at least three nips.

33. The process in accordance with claim 31, wherein the smooth transfer belt does not run through the one nip formed in part by the at least one press roll.

34. The process in accordance with claim 33, wherein the one nip formed in part by the at least one press roll is located downstream, relative to a web run direction, from the at least one nip through which the smooth transfer belt is guided.

35. The process in accordance with claim 34, wherein the one nip is a last nip in the press section.

36. The process in accordance with claim 34, wherein, upstream of the at least one nip through which the smooth transfer belt is guided, a first of the at least three nips is located, and the fibrous material web is sandwiched between two dewatering belts in the first nip.

37. A press section for dewatering a fibrous material web, the press section comprising:

a first nip formed by press rolls;

a second nip formed by press rolls and arranged downstream from the first nip;

a third nip formed by press rolls and arranged downstream from the second nip;

one of the press rolls forming the third nip having a smooth surface arranged to contact a surface of the fibrous material web;

a first endlessly circulating dewatering belt associated with the first nip, the first endlessly circulating dewatering belt being structured and arranged to guide the fibrous material web through the first nip and to receive water squeezed out of the fibrous material web in the first nip;

a second endlessly circulating dewatering belt associated with the second nip, the second endlessly circulating dewatering belt being structured and arranged to guide the fibrous material web through the second nip and to receive water squeezed out of the fibrous material web in the second nip;

a third endlessly circulating dewatering belt associated with the third nip, the third endlessly circulating dewatering belt being structured and arranged to guide the fibrous material web through the third nip and to receive water squeezed out of the fibrous material web in the third nip; and a smooth transfer belt associated with the second nip, the smooth transfer belt being structured and arranged to contact a surface of the fibrous material web opposite the surface contacting said smooth surface of the one of the press rolls, wherein, following the second nip, the second endlessly circulating dewatering belt transfers the fibrous material web directly to the third endlessly circulating dewatering belt.

38. The press section of claim 37, wherein the smooth transfer belt comprises an endlessly circulating smooth transfer belt.

39. The press section of claim 37, wherein one of the press rolls of the first and second nips comprises a shoe roll and wherein each of the first and second nips is an extended nip.

40. A process for dewatering a fibrous material web in a press section of claim 37, said process comprising:

guiding the fibrous material belt through each of the first, second and third nips;

contacting a surface of the fibrous material web with the smooth transfer belt, wherein the smooth transfer belt supports the fibrous material web through the second nip;

transferring the fibrous material web with the second endlessly circulating dewatering belt directly to the third endlessly circulating dewatering belt;

contacting a surface of the fibrous material web opposite the surface contacted by the smooth transfer belt with the smooth surface of the one of the press rolls; and transferring the fibrous material web directly from the one of the press rolls to a drying screen.

* * * * *